US005760493A

United States Patent [19]

Outcalt et al.

[11] Patent Number: 5,760,493

[45] Date of Patent: Jun. 2, 1998

[54] DISHWASHER AND CONTROL THEREFOR

[75] Inventors: Alan G. Outcalt, Goldsboro, N.C.; David W. Mundy, St. Joseph, Mich.; Robert H. Ashton, Watervliet, Mich.; Ryan K. Roth, St. Joseph, Mich.; Theodore F. Meyers, Troy, Ohio

[73] Assignee: Whirlpool Corporation, Benton Harbor, Mich.

[21] Appl. No.: 751,604

[22] Filed: Nov. 18, 1996

Related U.S. Application Data

[60] Provisional application No. 60/007,427, Nov. 21, 1995.

[51] Int. Cl.[6] ..... H02J 3/14

[52] U.S. Cl. ..... 307/38; 307/115; 307/132 E; 307/141.4; 364/492; 361/191; 134/57 D; 134/58 D

[58] Field of Search ..... 307/38, 37, 115, 307/132 E, 139, 141.4; 364/400; 361/191; 134/58 D, 57 D; 318/461, 462, 471, 489, 254, 434, 138; 68/12.01, 12.02

[56] References Cited

U.S. PATENT DOCUMENTS

| | | | |
|---|---|---|---|
| 3,414,789 | 12/1968 | Prouty | 318/221 |
| 3,656,005 | 4/1972 | Lee | 307/247 |
| 3,657,620 | 4/1972 | Fricker | 318/221 |
| 3,657,621 | 4/1972 | Fink, Jr. et al. | 318/221 |
| 3,766,457 | 10/1973 | Fink, Jr. et al. | 318/221 |
| 4,044,286 | 8/1977 | Adams et al. | 318/297 |
| 4,047,082 | 9/1977 | Scheuer et al. | 318/221 |
| 4,134,003 | 1/1979 | Hahn | 134/58 D |
| 4,182,351 | 1/1980 | Deaton et al. | 134/58 |
| 4,213,379 | 7/1980 | Kiefer et al. | 307/141.4 |
| 4,223,379 | 9/1980 | Simcoe | 307/141.4 |
| 4,241,400 | 12/1980 | Kiefer | 364/400 |
| 4,245,309 | 1/1981 | Kiefer | 364/400 |
| 4,245,310 | 1/1981 | Kiefer | 364/400 |
| 4,254,788 | 3/1981 | Helwig | 134/57 D |
| 4,305,122 | 12/1981 | Smith et al. | 364/144 |
| 4,329,596 | 5/1982 | Marcade | 307/141.8 |
| 4,395,671 | 7/1983 | Sandler et al. | 318/786 |
| 4,751,401 | 6/1988 | Beigel et al. | 307/140 |
| 4,804,901 | 2/1989 | Pertessis et al. | 318/786 |
| 5,006,767 | 4/1991 | Maruyama et al. | 318/103 |
| 5,184,026 | 2/1993 | O Breartuin | 307/139 |
| 5,202,582 | 4/1993 | Szynal et al. | 307/39 |

FOREIGN PATENT DOCUMENTS

| | | | |
|---|---|---|---|
| 2042524 | 2/1972 | Germany | E05B 47/00 |

*Primary Examiner*—William M. Shoop, Jr.
*Assistant Examiner*—Albert W. Paladini
*Attorney, Agent, or Firm*—Robert O. Rice; Thomas J. Roth; Joel M. Van Winkle

[57] ABSTRACT

The invention is a dishwasher and a control therefore in which the control comprises multiple parallel loads, including a motor. The motor and the other loads are connected to one side of a power source by a motor relay, which is controlled by a processor. All the loads, except the motor, are connected to the other side of a power source by semiconductor switches with each load having a corresponding switch. The motor has an unswitched connection to the other side of the power source. The power to all the loads, including the motor, is controlled by the motor relay. If one of the switches fails in such a way that the circuit for one of the loads is closed, then the load will be shut off when the motor relay is opened to shut off power to the motor. Thus, it is possible to prevent the failed load circuit from operating during the entire wash cycle.

12 Claims, 3 Drawing Sheets

DISHWASHER AND CONTROL THEREFOR

This application claims the benefit of U.S. Provisional Application No. 60/007,427 filed on Nov. 21, 1995.

FIELD OF THE INVENTION

The invention relates to a dishwasher and a control therefor, and, more specifically to a dishwasher and a control that shuts off power to failed electrical load circuits when power is not supplied to the motor, preventing the electrical load from continuing to operate for the entire operation of the dishwasher.

DESCRIPTION OF THE RELATED ART

Dishwashers commonly have a control that permits the user to select from various wash cycles and to select options for the various cycles. The dishwasher control receives the user inputs and controls the operation of the various components of the dishwasher, such as the pump, heater, detergent dispenser, etc. These components represent the electrical loads of the control. In prior controls, the circuit providing power to the loads have a main relay that controls the supply of power to the loads. The loads are normally switched so that they can be turned on and off as required. One problem with this type of control is that if one of the switches of the loads fails and the load circuit is left closed, then the load will continue to operate for the entire wash cycle because the main relay is closed for the entire wash cycle. The invention solves the problem of the prior dishwasher controls in a unique way which has the additional advantage of reducing the number elements needed in the control and thus reducing the cost of the control.

SUMMARY OF THE INVENTION

The invention is a dishwasher and a control therefor. The dishwasher comprises at least a first electrical load and a second electrical load, which are connected in parallel. The first and second loads are energized by a power source having a first and second supply lines. A relay having contacts connects the first electrical load and the second electrical load in series to the first supply line. A solid state device connects the second electrical load in series to the second supply line. The first load is connected directly to the second supply line whereby if the solid state device fails in the closed position, power to the second load can be controlled by opening and closing the relay contacts.

DETAILED DESCRIPTION OF THE EMBODIMENT

Figure 1:
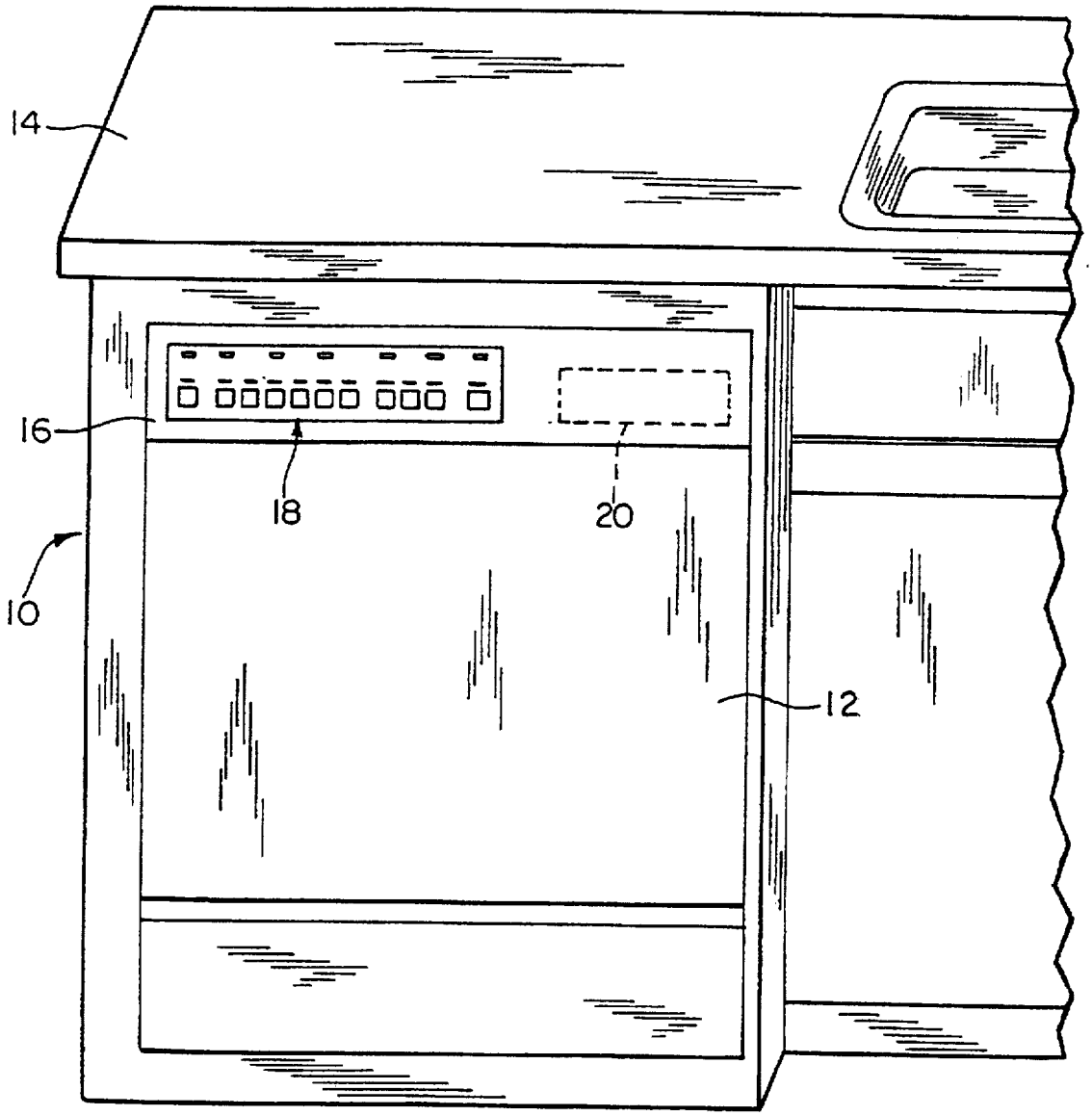
FIG. 1 is a perspective view of a front loading dishwasher having circuit operation provided in accordance with the principles of the invention.

In the exemplary embodiment of the invention as shown in the drawings, specifically FIG. 1, a typical dishwasher 10 comprises a cabinet 12 housing a washing chamber (not shown) retained beneath a countertop 14. The dishwasher 10 has a control console 16 which houses a switch module 18, exposed to the user, and a control module 20, enclosed inside control console 16.

The following are included in dishwasher 10 and, except for the control device, are not shown in the drawings. There are racks upon which dishes and utensils are placed. There is at least one spray arm for spraying water throughout the washing chamber. There is a motor driven pump, that together with suitable valves, actuators, a heater and necessary sensors, cooperate to carry out a number of different automatic cycles preprogrammed in a control device, which, in the preferred embodiment, comprises a microcomputer.

Figure 2:
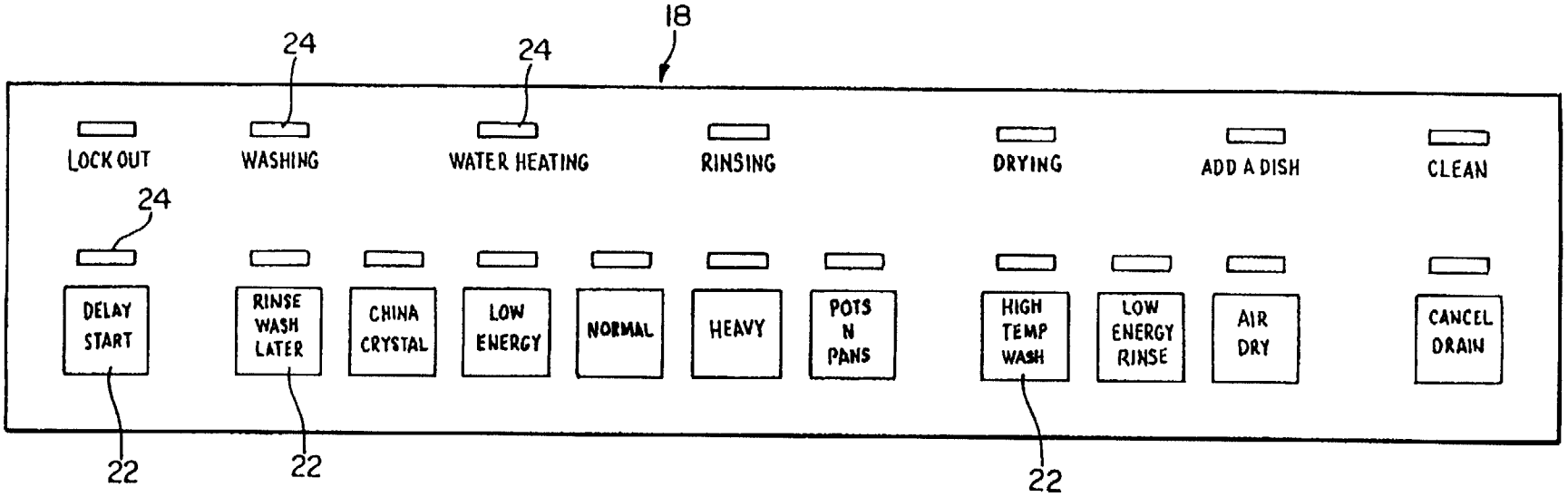
FIG. 2 is a switch module for a dishwasher.

Switch module 18 is shown enlarged in FIG. 2. It provides a number of switches 22 to enable a user to select dishwasher cycles and options, and display indicators 24 to display to the user information on the selections chosen and current status of the dishwasher. The switches 22, in combination, identify any one of a number of different automatic cycles within which the dishwasher is programmed to operate. In practice, automatic cycles such as POTS N PANS, HEAVY, NORMAL, LOW ENERGY, CHINA CRYSTAL, AND RINSE WASH LATER are typical. Operable within each automatic cycle, and selected by the user at 18, is an array of options. Examples of options which in practice are available in conventional dishwashers are DELAY START, AIR DRY, LOW ENERGY RINSE, HIGH TEMP WASH, and CANCEL DRAIN.

Figure 3:
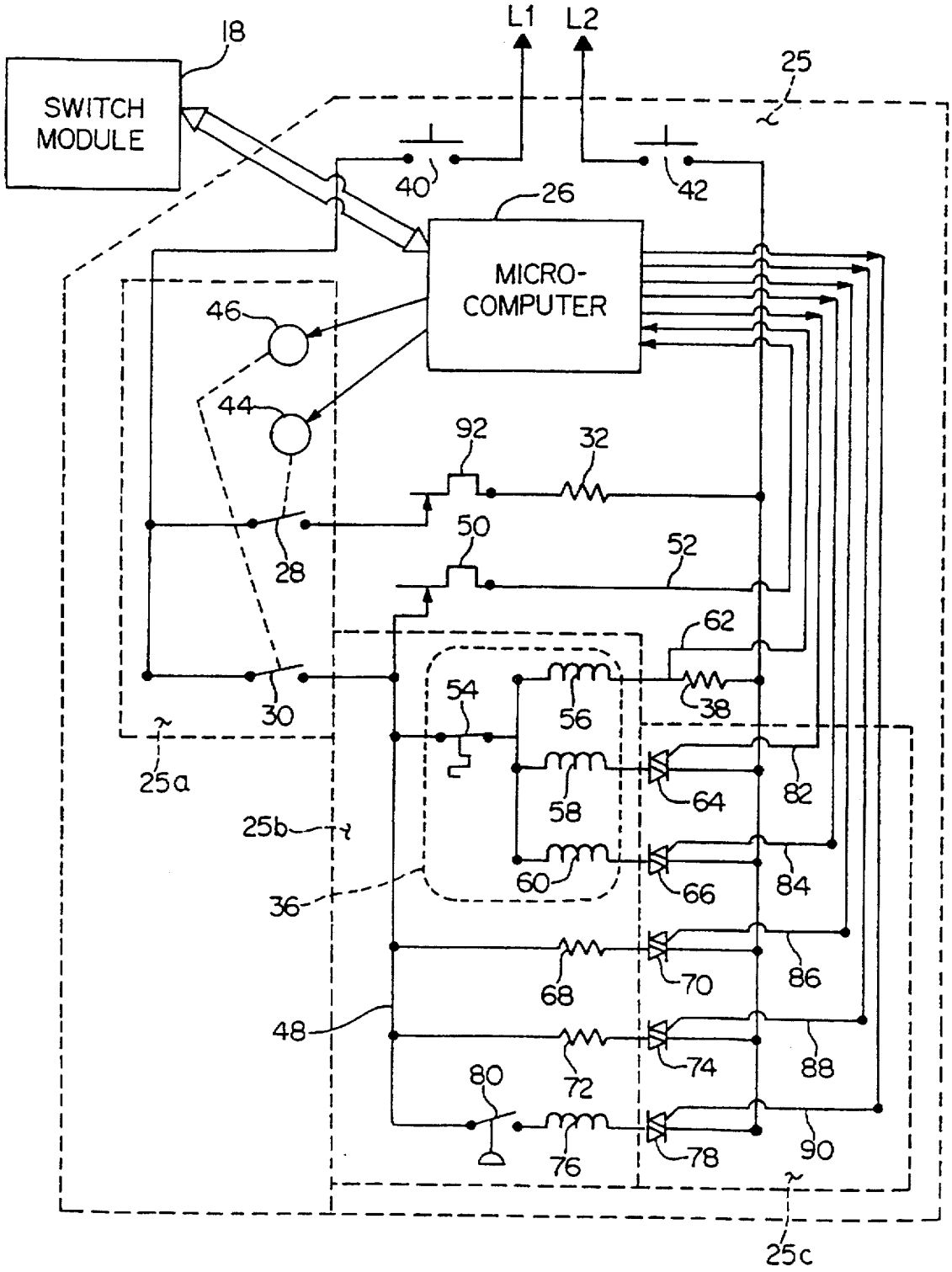
FIG. 3 is a schematic diagram of a dishwasher and a control operating in accordance with the principles of the invention.

FIG. 3 schematically illustrates the dishwasher control 25 according to the invention and is connected to the switch module 18 and a power source identified by lines L1 and L2. The control 25 receives input from the switch module 18 to control the operation of the dishwasher 10 (FIG. 1). For ease of understanding, the dishwasher control 25 will first be described conceptually by its functional components. Conceptually, the control 25 comprises a relay portion **25*a*, load portion 25*b*, a switch portion 25*c*, and a processor 26. The relay portion 25*a* connects the load portion 25*b* in series to line L1 of the power source. Similarly, the switch portion 25*c* is in series with and connects the load portion 25*b* to line L2 of the power source. The processor 26 is connected to the switch module 18 and the relay portion 25*a* and the switch portion 25*c* and controls the energizing of the relay portion 25*a* and the switch portion 25*c* in response to programming that is responsive to inputs received from the switch module 18. The relay portion 25*a* control the flow of power to the load portion 25*b* and the switch portion 25*c* controls the actuation of the loads as directed by the processor 26**.

Referring now to FIG. 1 in combination with FIG. 3, it can be understood that in the preferred embodiment, the control 25 comprises a control module 20, which is a circuit board disposed in control console 16. The control module 20 includes the relay portion **25*a*, switch portion 25*c* and the processor 26**. The load portion comprises typical electrical loads for a dishwasher and these loads are connected to the control module by a wiring harness in the typical manner known to one of skill in the art.

Looking at the control 25 in more detail, it can be seen that the load portion **25*b* contains multiple parallel loads, one of which is an electric motor 36. The electric motor 36 further comprises a main winding 56, a drain winding 58, and a wash winding 60. Other illustrated loads include a detergent actuator 68, a wetting agent actuator 72, and a fill solenoid 76. The relay portion 25*a* comprises a heater relay 44 and a motor relay 46 which have respective contacts 28, and 30, which are controlled by the processor. The processor in the preferred embodiment is a microcomputer 26. The switch portion 25*c* comprises multiple semiconductor switches 64, 66, 70, 74, and 78. All of the loads, except the main winding 56 of motor 36, have a corresponding semiconductor switch, which connects to line L2 of the power source, completing the circuit for each of the loads. The main winding 56 of motor 36** is directly connected to line L2. With this structure, if one or more of the semiconductor switches fail in the shorted condition, as is typical, the load will be turned off when the motor relay is opened to shut off power to the motor. Previous dishwasher controls used an additional relay, generally referred to as a main relay or a master relay to provided power to the loads during the entire operation of the dishwasher. The advantage of the invention is that the load connected to a failed, shorted semiconductor switch is turned off when the motor is not energized and is not left running during the entire operation of the dishwasher, like prior controls, and one less relay is required, reducing the number of components and cost of the control.

Referring to the control circuitry of FIG. 3, a microcomputer 26 is used to control the dishwashing process in this embodiment, other types of processors could be used instead. Microcomputer 26 connects the electrical loads to the power of L1 through the contacts of two electromechanical relays, heater relay contacts 28 and motor relay contacts 30. Heater relay contacts 28 are in series with heater element 32 which is also connected to L2. Motor relay contacts 30 are in series with load portion **25*b* (electrical loads that are connected in parallel, including the motor 36 and other loads to be energized while the motor 36 is running). One of the loads of load portion 25*b* is connected through sense resistor 38 to L2. The remaining loads of load portion 25*b* are each connected to L2 through one of the semiconductor switches, which are illustrated as triacs in the drawings, of switch group 25*c*. Each switch of group 25*c* is selectively controlled by Microcomputer 26**.

Microcomputer 26, located in control module 20 of FIG. 2, receives as inputs user selections entered manually by the user at switches 22 on the switch module 18, and sends as outputs to the display indicators 24 on switch module 18 information on the cycle and option selection as well as the current status of the dishwasher 10. The information received by the microcomputer 26 from the switch module 18 is typically in the form of digital signals developed as a function of the status of the switches 22 involved.

Referring more specifically to the electrical control circuitry illustrated in FIG. 3, supply leads L1 and L2 are connected respectively through a first door switch 40 and a second door switch 42 to the circuits of dishwasher 10. Further, the heater relay contacts 28 of heater relay 44 are connected through the hi-limit thermostat 92 to the heater element 32. The motor relay contacts 30 of motor relay 46 are connected to the wiring node 48. The operating thermostat 50 connects the wiring node 44 to the stat input 52 of microcomputer 26. The thermal protector 54 connects the main winding 56, the drain winding 58, and the wash winding 60, all components of the motor 54, to the wiring node 48. The main winding 56 also connects to the sense input 62 of microcomputer 26 and the sense resistor 38. The drain winding 58 also connects to the drain triac 64. The wash winding 60 also connects to the wash triac 66. The detergent actuator 68 is connected between the detergent triac 70 and the wiring node 48. The wetting agent actuator 72 is connected between wetting agent triac 74 and the wiring node 48. The fill solenoid 76 is connected to fill triac 78 and to wiring node 48 through overfill switch 80. The microcomputer outputs drain 82, wash 84, detergent 86, wetting agent 88, and fill 90 are all connected to the gate of the triac driving that respective load.

Power is applied through the normally open door switches 40 and 42, therefore, power is available only when the dishwasher door is in the closed position.

Heat is provided when microcomputer 26 energizes the heater relay 44 that applies power through the heater relay contacts 28 and the hi-limit thermostat 92 to the heater element 32.

To provide pumping, dispensing, and filling operations, the microcomputer 26 energizes the motor relay 46, closing motor relay contacts 30 to apply power to the wiring node 48 which includes one end of load portion **25*b*. Microcomputer 26 must also energize the appropriate triac (semiconductor switch) turning the triac on, connecting the selected load to L2. This means that triacs (64, 66, 70, 74 and 78) are not subject to electrical line transients when the motor relay contacts 30 are open; and, any load driven by a failed shorted triac will be turned off when the motor relay contacts 30** are opened.

To drain dishwasher 10, microcomputer 26 initiates a starting sequence for the motor 36. Microcomputer 26 energizes motor relay 46 to apply power to wiring node 48 and then waits for 30 milliseconds for motor contacts 30 to close and stop bouncing. During this time motor contacts 30 are controlling the locked rotor current (current that flows in the electrical motor's windings when the rotor is not turning) of the motor's main winding 56 that flows through the thermal protector 50, the main winding 56, and the sense resistor 38, therefore the requirements of motor contacts 30 are less than would be necessary if the locked rotor current of the start winding was also included. Microcomputer 26 will then energize output drain 82 that turns on the drain triac 64 that applies power to the drain winding 58. The microcomputer 26 then waits 300 milliseconds while the rotor (not shown) of motor 54 comes up to speed. After the 300 millisecond delay, microcomputer 26 will monitor the sense input 62 looking for a specific threshold voltage. When the voltage at sense input 62 goes below this threshold voltage, microcomputer 26 will turn off drain triac 64 which ends the starting sequence. The threshold for sense input 62 is set for 10 amps of current flowing through sense resistor 38.

To wash or rinse in dishwasher 10, the same procedure discussed above is followed except that the microcomputer 26 output wash 84 is energized to turn on the wash triac 66 and apply power to the wash winding 60 during the starting sequence, instead of output drain 82, drain triac 64, and drain winding 58. Microcomputer 26 terminates a thermal hold of a washing or rinsing timing period when operating thermostat 50 opens and cuts the supply voltage to stat input 52.

Power is applied and terminated to the remaining electrical loads (detergent actuator 64, wetting agent actuator 68, and the fill solenoid 72) by microcomputer 26 turning on and off the respective triac at the specific time it is needed in the program. Consideration to reduce the current handling and switching requirements of motor relay contacts 30 goes in to choosing the specific time. Power is applied to these loads only after the motor 36 has completed the starting sequence, therefore the motor relay contacts 30 do not handle the current of these loads and the large motor starting current at the same time. Power is turned off to these loads at least one electrical line cycle before the motor relay 46 is de-energized; therefore, the motor relay contacts 30 need only break the motor run current.

Thus, the invention teaches to use electrical relay contacts 30 to apply the supply voltage L1 to one side of at least two electrical loads (56, 58, 60, 68, 72 and 78) in parallel, with at least one of the loads 56 being connected to the other side of the supply voltage L2 either directly or through a non-switched item like the sense resistor 38. The other loads (58, 60, 68, 72 and 78)are completed through semiconductor switches (such as a triac) to the other side of the supply voltage L2. A benefit of the motor starting arrangement described in the embodiment is that it allows a reduction of the electrical requirements of the motor relay contacts 30. The reason is that at start, the full (main winding plus start winding) locked rotor motor current is normally controlled by the contacts of a motor relay, but for the disclosed arrangement, the motor relay contacts 30 only have to control the locked rotor current of the main winding 56. In the embodiment, motor contacts 30 provide a positive contact gap to turn off the semiconductor switched electrical loads should a semiconductor switch fail. Motor contacts 30 also reduce the time period that the semiconductor switches are subject to supply line (L1, L2) transients to the period that the relay contacts are closed.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim:

1. An appliance comprising:

at least a first electrical load and a second electrical load that are connected in parallel and are energized by a power source having first and second supply lines;

a relay having contacts and the relay contacts connecting the first electrical load and the second electrical load in series to the first supply line;

a solid state device connecting the second electrical load in series to the second supply line; and the first electrical load is connected directly to the second supply line such that energization of the first electrical load is controlled by closing and opening the relay contacts and whereby if the solid state device fails in the closed position, power to the second load can be controlled by opening and closing the relay contacts such that the second load is de-energized when the first load is de-energized during the appliance operation.

2. An appliance as claimed in claim 1, wherein the first load has first and second free ends and the first free end is connected to the relay contacts and the second free end is connected to the second supply line to form the direct connection.

3. An appliance as claimed in claim 2, wherein the second load has first and second free ends and the first free end is connected to the relay contacts and the second free end is connected to the solid state device.

4. An appliance as claimed in claim 1, wherein the first load is an electric motor.

5. An appliance as claimed in claim 4, wherein the electric motor comprises at least a main winding and the main winding is the first load.

6. An appliance as claimed in claim 1, wherein the second load is an actuator.

7. An appliance as claimed in claim 6, wherein the actuator is a solenoid.

8. An appliance as claimed in claim 6, wherein the actuator is a heater.

9. An appliance as claimed in claim 1, and further comprising a processor connected to the relay and to the solid state device for controlling the operation of the relay and the solid state device.

10. An appliance as claimed in claim 9, wherein the processor is a microcomputer.

11. An appliance as claimed in claim 9, and further comprising a switch module connected to the processor for receiving user inputs and supplying corresponding inputs to the processor.

12. An appliance comprising:

a motor and at least one other electrical load that are connected in parallel and are energized by a power source having first and second supply lines;

a relay having contacts and the relay contacts connecting the motor and the at least one other electrical load in series to the first supply line, the motor being connected directly to the second supply line;

a solid state device connected in series with the at least one other electrical load; and a microcomputer interconnected to the relay and the solid state device for controlling their operation and for selectively energizing the first electrical load and the second electrical load, wherein if the solid state device fails in the closed position, power to the second load can be controlled by the control means opening and closing the relay contacts during the appliance operation.

* * * * *